US007448149B2

(12) United States Patent
Preskar et al.

(10) Patent No.: US 7,448,149 B2
(45) Date of Patent: Nov. 11, 2008

(54) CUSHIONING ASSEMBLY IN AN ATHLETIC SHOE

(75) Inventors: David Joseph Preskar, Westlake Village, CA (US); Kenneth J. Liu, Westlake Village, CA (US); Graham Jelley, Taichung (TW)

(73) Assignee: K-Swiss Inc., Westlake Village, CA (US)

( * ) Notice: Subject to any disclaimer, the term of this patent is extended or adjusted under 35 U.S.C. 154(b) by 0 days.

(21) Appl. No.: 10/716,555

(22) Filed: Nov. 20, 2003

(65) Prior Publication Data

US 2005/0108896 A1 May 26, 2005

(51) Int. Cl.
*A43B 13/28* (2006.01)
*A43B 13/18* (2006.01)

(52) U.S. Cl. ..... 36/27; 36/28; 36/35 R

(58) Field of Classification Search ..... 36/28, 36/29, 38, 37, 27, 7.8, 30 R, 31, 158, 168, 36/179

See application file for complete search history.

(56) References Cited

U.S. PATENT DOCUMENTS 4,262,433 A * 4/1981 Hagg et al. ..... 36/25 R
4,535,553 A 8/1985 Derderian et al.
4,592,153 A * 6/1986 Jacinto ..... 36/38
4,638,575 A 1/1987 Illustrato
4,712,314 A 12/1987 Sigoloff
4,766,679 A 8/1988 Bender
4,843,741 A 7/1989 Yung-Mao
4,845,863 A 7/1989 Yung-Mao
4,972,611 A 11/1990 Swartz et al.
5,005,300 A 4/1991 Diaz et al.
5,060,401 A 10/1991 Whatley
5,092,060 A 3/1992 Frachey et al.
5,195,256 A 3/1993 Kim
5,203,095 A * 4/1993 Allen ..... 36/27
5,224,280 A * 7/1993 Preman et al. ..... 36/30 R
5,311,674 A 5/1994 Santiyanont et al.
5,331,750 A 7/1994 Sasaki et al.
5,343,639 A * 9/1994 Kilgore et al. ..... 36/29
5,369,896 A 12/1994 Frachey et al.
5,402,588 A 4/1995 Graham et al.
5,542,195 A 8/1996 Sessa
5,544,431 A * 8/1996 Dixon ..... 36/38
5,649,374 A * 7/1997 Chou ..... 36/27
5,729,916 A 3/1998 Vorobiev et al.
5,782,014 A 7/1998 Peterson
5,860,226 A 1/1999 Graham et al.
6,098,313 A 8/2000 Skaja
6,393,731 B1 * 5/2002 Moua et al. ..... 36/27
6,477,789 B2 * 11/2002 Cheng ..... 36/3 B (Continued)

*Primary Examiner*—Jila M Mohandesi
(74) *Attorney, Agent, or Firm*—Oblon, Spivak, McClelland, Maier & Neustadt, P.C.

(57) ABSTRACT

An athletic shoe includes a sole assembly and a cushioning arrangement disposed within the sole assembly. The cushioning arrangement includes a cushioning element, and a stiffening spring at least partially surrounding the cushioning element. The spring has a stiffness greater than the cushioning element. The athletic shoe can include a sole assembly having cushioning arrangements provided across a width of the sole assembly. In a preferred arrangement, similar cushioning assemblies are disposed on medial and lateral sides of the shoe, with three additional cushioning assemblies provided between the lateral and medial assemblies. Each of the lateral and medial assemblies can include a stiffening spring that at least partially surrounds at least one cushioning element.

14 Claims, 6 Drawing Sheets

U.S. PATENT DOCUMENTS 6,546,648 B2 * 4/2003 Dixon ..... 36/27
6,562,427 B2 * 5/2003 Hung ..... 36/28
6,568,102 B1 * 5/2003 Healy et al. ..... 36/28
6,751,891 B2 * 6/2004 Lombardino ..... 36/28
6,807,753 B2 * 10/2004 Steszyn et al. ..... 36/28
2002/0088143 A1 7/2002 Brooks et al.
2002/0129516 A1 9/2002 Lucas et al.
2004/0154191 A1 * 8/2004 Park ..... 36/28

* cited by examiner

CUSHIONING ASSEMBLY IN AN ATHLETIC SHOE

FIELD OF THE INVENTION

The invention relates to athletic shoes, and particularly to a cushioning arrangement or cushioning assembly for athletic shoes. Although the cushioning assembly is particularly advantageous for use in a heel region of the shoe, the assembly or certain aspects of the assembly could be utilized in other portions of the shoe.

BACKGROUND OF THE INVENTION

DISCUSSION OF BACKGROUND

A wide variety of cushioning arrangements have been available in athletic shoes. The cushioning arrangements are generally designed to absorb energy in order to protect the foot. However, if a cushioning assembly is poorly designed, it can suffer from several disadvantages. For example, if the arrangement is excessively soft, it can hinder the performance of the shoe, inadequately protect the foot from high impact forces, and/or the arrangement can be unstable which could potentially lead to injury. Further, if the arrangement is excessively rigid, inadequate protection could also result in that the forces or energy is not sufficiently absorbed by the cushioning assembly such that excessive forces are transmitted directly to the foot. Further, excessively stiff or rigid cushioning arrangements can also result in poor stability. Thus, cushioning assemblies must be designed so that they are not excessively soft, which could result in forces being directly transmitted to the foot when the assembly is fully compressed or "bottoms out," while also not being excessively rigid so as to directly transmit the forces to the foot by virtue of inadequate absorption of energy. The ability to optimally balance the trade-off between soft/cushioning elements (which could bottom out) and stiff cushioning elements (which might not sufficiently absorb forces or energy) can be difficult. Further, the cushioning assembly should be capable of maintaining superior stability of the shoe, and moreover, provide a desirable "ride" of the shoe in use.

U.S. Pat. No. 5,782,014, which is assigned to the same assignee of the present application, provides an example of a known cushioning arrangement. In this arrangement, a cushioning assembly, in the form of opposing truncated cones, is provided in the heel and forefoot regions of the shoe.

It can also be desirable to be able to see, from the exterior of the shoe, the cushioning elements that are provided in a shoe. A display of the cushioning elements can be desirable aesthetically and from a standpoint of providing information to the purchaser/user. A further feature disclosed in the '014 patent is the use of a mock window which provides a representation of the cushioning elements disposed in the interior of the shoe. Prior to the '014 arrangement, window arrangements were known in which the actual cushioning elements in the interior of the shoe were visible through a window (see, e.g., U.S. Pat. No. 4,845,863). The prior window arrangements were desirable from an aesthetic standpoint and also to provide the user/purchaser with information concerning the cushioning elements disposed within the shoe. The use of a mock window in lieu of a window provided an improvement in terms of the flexibility (i.e., variety) of what can be displayed within the mock representation, and also in terms of improving the stability of the assembly.

SUMMARY OF THE INVENTION

It is an object of the invention to provide a cushioning assembly for use in athletic shoes. The assembly includes features providing cushioning as well as sufficient support to reduce the possibility of bottoming out (i.e., reducing the possibility of maximum compression being achieved such that the forces are directly transferred to the foot). Further, the arrangement includes features providing improved stability of the shoe, and a desirable "ride."

According to one of the advantageous aspects of the invention, cushioning elements are provided in combination with a more rigid spring assembly or stiffening spring. According to the illustrated embodiment, the arrangement is in the form of a rigid spring or leaf spring assembly having cushioning elements disposed therein. The cushioning elements provide adequate cushioning or energy absorption while the more rigid spring or stiffening spring arrangement provides improved stability and minimizes the risk that the assembly will bottom out.

According to further aspect of the invention, the rigid spring arrangement is provided at only selected portions of the shoe so that the overall arrangement is not excessively stiff. According to the illustrated embodiment, the combination of the rigid or stiffening spring and cushioning elements is provided adjacent the lateral and medial sides of the shoe.

According to a further aspect of the invention, different cushioning arrangements are provided traversing a width of the shoe. According to the illustrated embodiment, the combined stiffening spring and cushioning elements are provided adjacent lateral and medial sides of the shoe, and inside of each of these assemblies only cushioning elements are provided. Further, disposed between these cushioning elements is a central assembly provided with another different arrangement of cushioning elements (a series of transversely extending ribs in the illustrated embodiment).

According to a still further aspect of the invention, an arrangement is provided to yield improved appearance characteristics while maintaining or even improving the stability of the shoe. In the illustrated embodiment, the more rigid spring assembly is provided at the exterior sides of the shoe, and the cushioning elements are visible through the rigid spring arrangement. This assembly allows the purchaser/user to view the cushioning elements and, because the cushioning elements are disposed within the more rigid spring, the ability to see these cushioning elements does not jeopardize the integrity of the shoe as could be the case with prior window arrangements. Further, in contrast to prior window-type arrangements, the aperture provided by the rigid spring allows for the direct viewing of the cushioning elements (i.e., the rigid springs are directly exposed to the exterior of the shoe and need not be viewed through a window pane). This arrangement can be advantageous in a number of respects. First, the arrangement allows the purchaser/user to actually touch and feel the cushioning elements. Second, the appearance can be superior in that window panes can tend to become scuffed or fatigued, which can detract from the appearance. Further, certain window pane arrangements can tend to distort or impair the view of the cushioning elements, particularly when viewing the cushioning elements from various angles. Other advantageous aspects of the display according to the invention are also provided as discussed in further detail herein.

As should be apparent from the above and will become further apparent from the detailed description herein, the present invention includes a number of advantageous features. It is to be understood that each and every one of the features need not be present in combination, but rather, certain features could be utilized in combination without other features, or the features could be utilized separately (or alone without other features).

BRIEF DESCRIPTION OF THE DRAWINGS

The above and additional objects and advantages of the invention will become readily understood in view of the detailed description herein, particularly when considered in conjunction with the drawings in which.

DETAILED DESCRIPTION OF THE PREFERRED EMBODIMENTS

Figure 1:
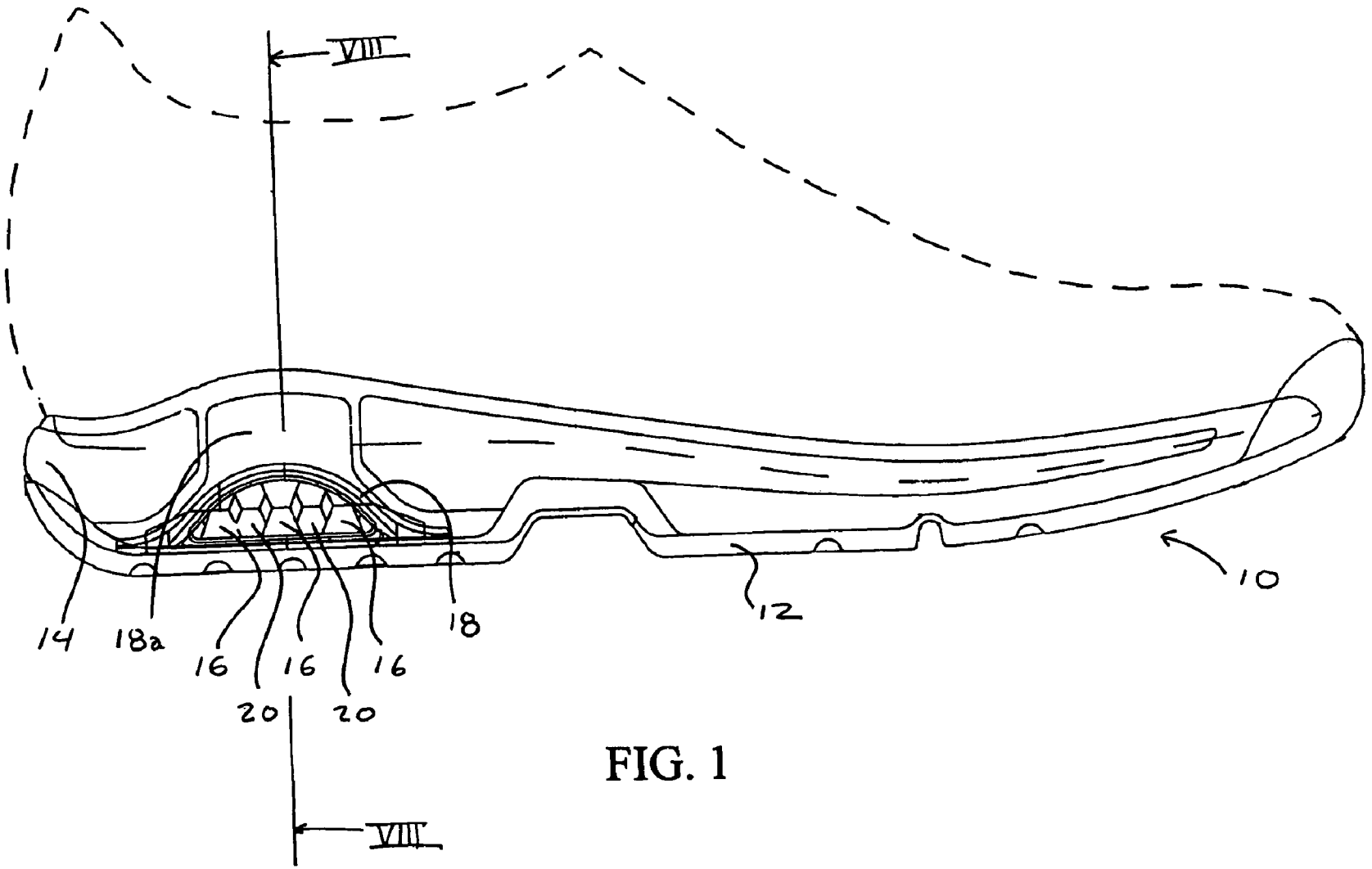
FIG. 1 is a side view of the medial side of a sole assembly having an example of a cushioning arrangement of the invention.

Referring to the drawings, wherein like reference numerals designate like or corresponding parts throughout the several views, a preferred embodiment of the invention will be described. However, it is to be understood that the embodiment is provided as an example, and it should be apparent that other embodiments are possible and each and every feature of the illustrated embodiment need not be utilized in accordance with the invention. For example, as will be described herein, three different cushioning arrangements or assemblies are provided across the width of the shoe in five different regions across the width. However, a different number of cushioning arrangements (or types of cushioning arrangements) could be provided. Also, although the cushioning assembly is preferably provided in the heel region of the shoe, features of the invention could also be advantageously utilized in other regions of the shoe as well.

Figure 2:
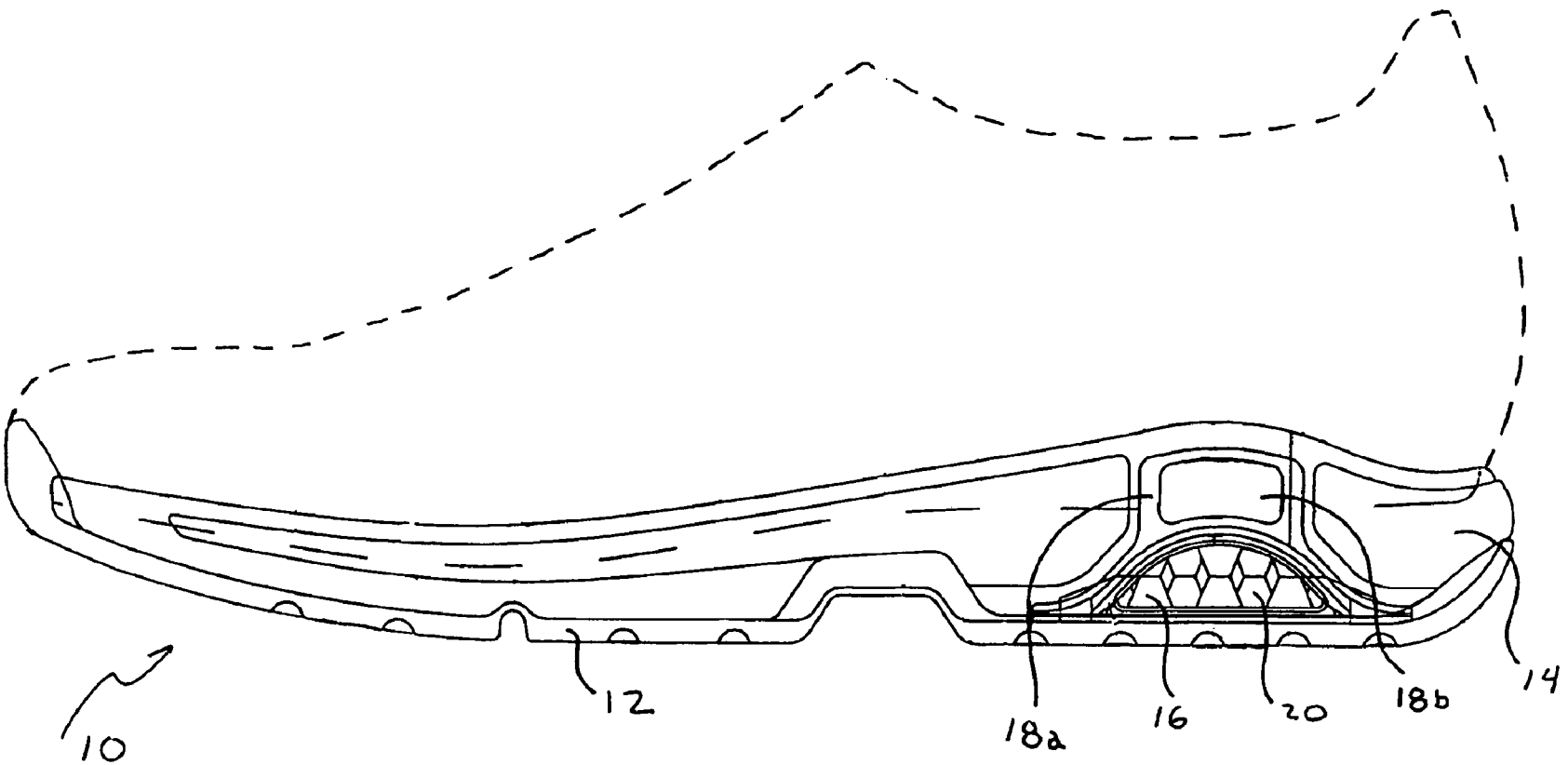
FIG. 2 is a side view of the lateral side of a shoe assembly shown in FIG. 1.

Referring to FIGS. 1 and 2, medial and lateral sides of the sole assembly according to an exemplary embodiment are shown. As used herein, sole assembly refers to one or more components provided in either a sole or midsole of a shoe. In the illustrated arrangement, the sole assembly 10 includes a sole or outsole 12 and a midsole 14. The cushioning arrangements are associated with the midsole 14, but they could also be associated with the sole 12 depending upon the configuration of the shoe. Further, the terms sole and midsole are not always utilized consistently in the industry, and moreover, depending upon the overall shoe design, different shoe designs have different numbers of layers depending upon the way in which the layers are formed (the extend to which layers are formed separately or integrally) of the overall design of the shoe. Thus, the term sole assembly is utilized generically herein to refer to one or more components of a sole or midsole arrangement of a shoe.

The cushioning arrangement, as shown in FIGS. 1 and 2, includes cushioning elements 16 disposed within a more rigid or stiffening spring such as leaf spring assembly 18. The cushioning elements 16 are depicted as having an hourglass shape of opposing truncated cones. However, it is to be understood that a wide variety of shapes and forms of cushioning elements are possible. Although not required, according to a particularly preferred arrangement, it is preferable to provide spaces between the cushioning elements 16 so that other cushioning elements that are disposed behind the cushioning elements 16 are also visible. Specifically, as shown in FIGS. 1 and 2, cushioning elements 20 are visible between the cushioning elements 16.

As discussed in further detail herein, in accordance with the illustrated embodiment, the cushioning elements 20 are not disposed within the more rigid spring or stiffening spring 18, but are disposed adjacent to the arrangement that includes the leaf spring 18 having the cushioning elements 16 disposed therein. More specifically, when viewed from the sides as shown in FIGS. 1 and 2, cushioning elements 20 are disposed behind the leaf spring/cushioning element combination (i.e., with respect to a widthwise direction transverse to that shown in FIGS. 1 and 2, the cushioning elements 20 are disposed closer toward the center axis of the shoe as compared with the stiffening spring/cushioning element combination 18, 16). More particularly, referring briefly to FIG. 8, which is a view along the cross-section VIII-VIII of FIG. 1, the presently preferred arrangement includes a cushioning assembly on each of the lateral and medial sides of the shoe which includes the more rigid spring or stiffening spring arrangement 18 having the cushioning elements 16 disposed therein.

In the illustrated form, an optional tab **18*a* extends upwardly along a side portion of the midsole 14. This tab 18*a* can be advantageous in a number of respects. First, it can provide additional support to the sidewall of the midsole or sole assembly. Further, the tab can assist in providing better integrity of the shoe from a standpoint of interlocking or providing a more stable coupling of the spring assembly to the shoe. Further, the tab 18*a* can provide a convenient location upon which a logo 18*b*** can optionally be placed.

Figure 8:
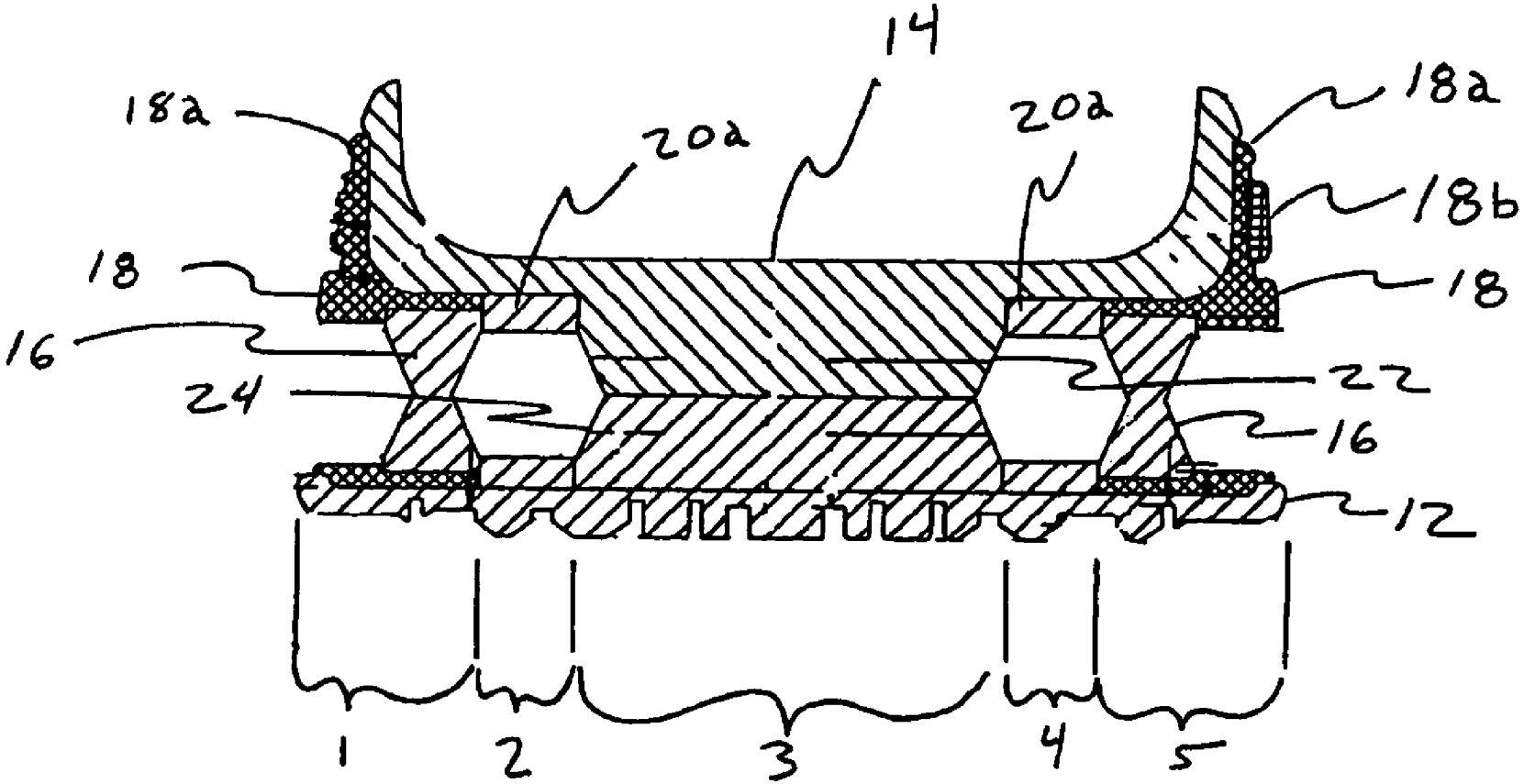
FIG. 8 is a cross-section of the heel region of the assembly of the illustrated embodiment extending across the width of the shoe.

Still referring to FIG. 8, disposed adjacent to each combined assembly is a cushioning assembly that does not include the more rigid or leaf spring arrangement. This interiorly disposed assembly in the illustrated arrangement includes only cushioning elements 20 which, in the preferred form are bounded by or encircled by a perimeter **20*a*. Within this perimeter 20*a*, the cushioning elements 20 are disposed. The cushioning elements 20 shown in FIGS. 1 and 2 are not seen in FIG. 8, because the cross-section is cut across the cushioning elements 16 and, in the preferred arrangement, the cushioning elements 20 are staggered with respect to the cushioning elements 18 (and the cross-section line thus cuts through the cushioning element 16 of FIG. 1 but not through the cushioning elements 20). This staggered relationship can provide improved stability for the shoe by staggering the locations at which cushioning elements are present. Further, by staggering the cushioning elements and providing the spacing therebetween, the cushioning elements of the adjacent row (i.e., the row 20) are visible between the cushioning elements 16** that are adjacent to the exterior sides of the shoe.

An additional cushioning arrangement is provided in the central region of the shoe. In the illustrated form, this includes a cushioning arrangement 22 which is part of the midsole 14, and an opposing cushioning arrangement 24. Each of the arrangements 22, 24 can be formed of the same material as the midsole, for example, of a foamed synthetic material, such as an EVA (ethylene vinyl acetate). Alternately, the central cushioning arrangement could be formed of a material different from that of the midsole 14. Further, instead of being formed as two pieces (one part 22 which is part of the midsole and another part 24 which is separate) a single or one-piece arrangement could be provided in this central region, or two or more separate pieces could be provided.

As noted earlier, and as should be apparent from the cross-section of FIG. 8, with the illustrated embodiment, three different cushioning arrangements are provided in five different regions across the width of the shoe. Specifically, in regions 1 and 5 of FIG. 8, on the lateral and medial sides of the shoe, the cushioning assemblies include the combination of cushioning elements 16 and the more rigid stiffening spring or leaf spring assembly 18 are provided. In regions 2 and 4, adjacent and disposed interiorly of the regions 1 and 5, only the cushioning elements 20 are provided (i.e., without a stiffening spring). The cushioning elements 20 in the illustrated embodiment are essentially the same as the cushioning elements 16, but are preferably staggered or offset with respect to the cushioning elements 16 as stated above. It is to be understood, however, that the cushioning elements 20 in the regions 2 and 4 could be different from the cushioning elements 16. Further, in the regions 2 and 4, the perimeter 20*a* surrounding the cushioning elements 20 can be thicker than a perimeter 16*a* surrounding the cushioning elements 16, due to the fact that a larger space is provided in regions 2 and 4 because the stiffening spring 18 is not present, and in addition, the thicker perimeter 20*a* can improve the stability with respect to the cushioning elements 20. Finally, in the central region 3, a third type of cushioning is provided by the opposed cushioning arrangements 22, 24.

Although in the exemplary embodiment of the invention described thus far three different cushioning arrangements are provided in five different regions, as noted above, a different number of types of cushioning arrangements could be provided. For example, a larger number of different types of cushioning elements could be provided across the width of the shoe. Also, a single cushioning arrangement could be provided across the width of the shoe. For example, in lieu of the arrangement shown in FIG. 8, the more rigid spring 18 could extend across the entire width of the shoe with cushioning elements 16 disposed throughout the width of the shoe, such that essentially this combined stiffener/cushioning element combination is provided across the entire width. Thus, it should be readily apparent that a number of variations are possible in light of the teachings herein.

The stiffener or more rigid spring assembly 18 is referred to as such herein because the stiffness of this assembly is greater than that of the cushioning elements 16. The degree of stiffness provided will depend upon a number of factors including the relative stiffness of the materials (e.g., so that, in combination, the desired rigidity and shock absorption are achieved), and the relative dimensions over which the stiffening arrangement is provided. For example, a slightly less stiff or rigid arrangement 18 might be desirable in the case where the assembly 18 extends across the entire width of the shoe.

Although the stiffening spring can extend across the width of the shoe as noted above, the illustrated arrangement described herein is presently preferred, because an arrangement in which the assembly 18 extends across the entire width of the shoe was believed to be somewhat bulky and potentially less comfortable than the thus described arrangement. The illustrated arrangement advantageously provides the combined stiffening and cushioning at the sides of the shoe to prevent bottoming out of the cushioning elements and to enhance the stability of the shoe. Further, this increased stiffness at the sides of the shoe is desirable in that, at the sides of the shoe, the cushioning elements can be viewed therethrough, while the integrity of the periphery of the shoe is not jeopardized (in fact, it can be enhanced) due to the enhanced stiffness provided by the stiffener or more rigid spring assembly 18. Further, the enhanced stiffness at the side of the shoe can be desirable in a number of activities. For example, in activities such as tennis or basketball, where the amount of lateral movement is significant, the stiffness at the sides of the shoe provides enhanced support for such lateral movement. Further, where the activity involves less lateral movement, such as running or jogging, this support at the edges is desirable in providing a better gate or ride in that the increased support at the side edges further promotes linear movement, thereby decreasing the chances of roll out or roll in movements which can detract from a performance standpoint and/or result in injury.

In operation, the arrangement is capable of absorbing energy when subjected to impact, and releasing the energy to propel the foot forward as the energy is released.

Figure 5:
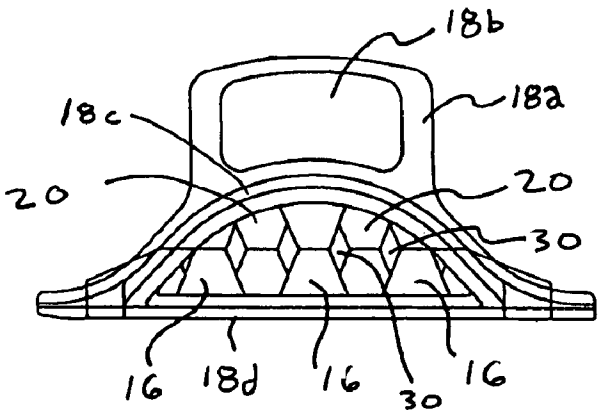
FIG. 5 depicts the rigid or stiffening spring having cushioning elements therein.
Figure 6:
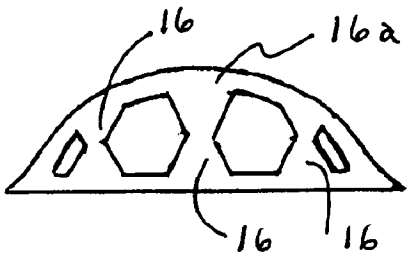
FIG. 6 depicts an arrangement of cushioning elements which can be provided inside of the rigid spring arrangement of FIG. 5, and/or adjacent to the rigid spring arrangement of FIG. 5.

FIG. 5 is an isolated view of the combined rigid spring 18 and cushioning elements 16, with the adjacent cushioning elements 20 also depicted. FIG. 6 depicts the cushioning elements 16 without the more rigid spring or stiffening spring 18. As is apparent, the cushioning elements 16 can be formed as a unit that can be inserted within the more rigid or more stiff assembly 18. The periphery or perimeter 16*a* of this unit is formed of a shape corresponding to the interior of the spring assembly 18. Similarly, the cushioning elements 20 can be formed as a unit having the perimeter 20*a* therearound (as shown in FIG. 8) of the same shape as that of the perimeter 16*a* shown in FIG. 6. As noted, however, in the illustrated embodiment, the cushioning elements 20 are preferably staggered with respect to the cushioning elements 16. Thus, by way of example, if a row of three cushioning elements 16 is provided within the spring assembly 18, the adjacent cushioning elements 20 can be provided in a row of two offset from the elements 16. The foregoing numbers of cushioning elements are provided as an example, and it is to be understood that the number of cushioning elements in a given row can vary. For example, although plural space cushioning elements are illustrated, a single cushioning element could be provided which partially or entirely fills the interior of the stiffening spring 18. Further, a larger number of cushioning elements than that illustrated could be provided. Further, the cushioning elements could be positioned such that there is little or no spacing therebetween.

Referring back to FIG. 5, it will be appreciated that in the illustrated embodiment, the upper portion 18*c* of the spring assembly 18 is arcuate or curved, while the bottom portion 18*d* is more flat, and preferably is substantially flat. It is to be understood, however, that various shapes are possible. The arrangement shown is presently preferred in that it allows for the absorption and/or release of forces at various angles by virtue of the arcuate or non-flat top, while the more flat base 18*d* provides desirable stability. The provision of cushioning elements that are tapered in their central region (an hourglass shape in the illustrated embodiment) is desirable in not only providing progressive cushioning or energy absorption upon deflection, but also from an aesthetic or appearance standpoint. Specifically, the tapered central portions of the cushioning elements provides the ability to view the cushioning elements 20 that are adjacent and behind the cushioning elements 16. Further, the hourglass shape is further desirable in providing a series of diamonds or diamond-like shapes. Specifically, as shown in FIG. 5, a diamond-like shape is provided between the hourglass shaped elements 16. In addition, a series of smaller diamonds 30 appear between a cushioning element 16 and a cushioning element 20. Thus, a series of appealing shapes are presented between the cushioning elements of a given row and between the cushioning elements of adjacent rows. Further, spaces between adjacent ribs of the central cushioning element can be aligned with the spaces 30 if desired so as to provide a line of sight extend through the width of the shoe: through the spaces 30 on one side of the shoe, between the ribs in the central region, and through the spaces 30 on the other side of the shoe.

Figure 3:
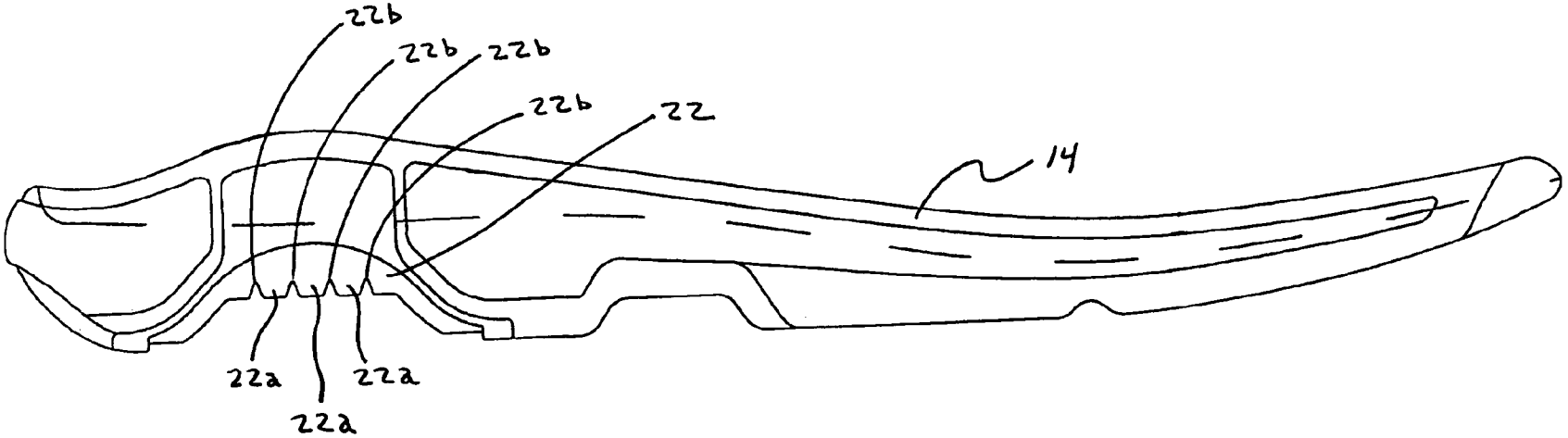
FIG. 3 is a side view of a portion of the sole assembly of FIGS. 1 and 2 with the sole or outsole removed, and with the cushioning elements and spring assembly not present.
Figure 4:
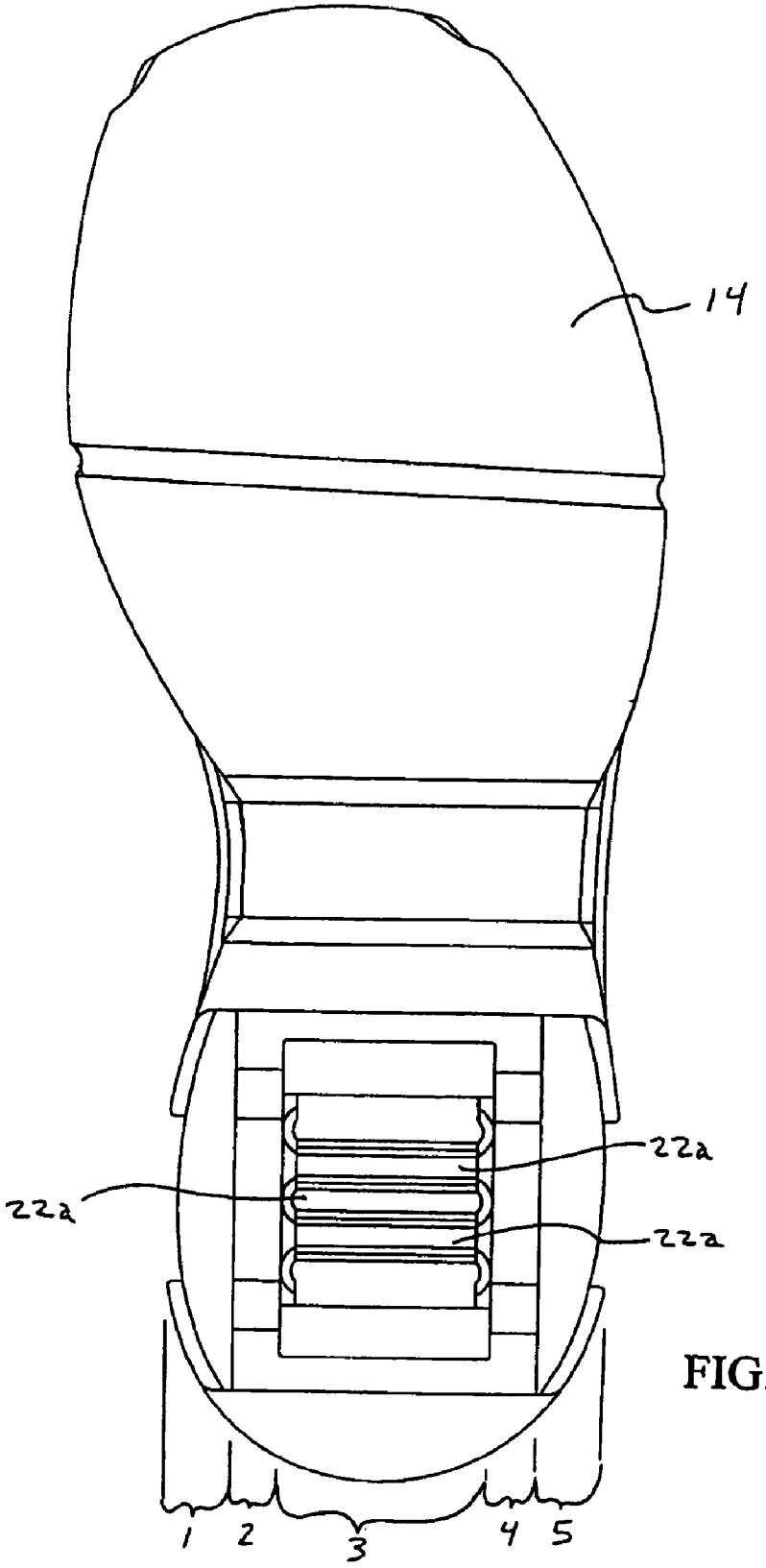
FIG. 4 is a plan view of the bottom of the portion of the sole assembly shown in FIG. 3.
Figure 7:
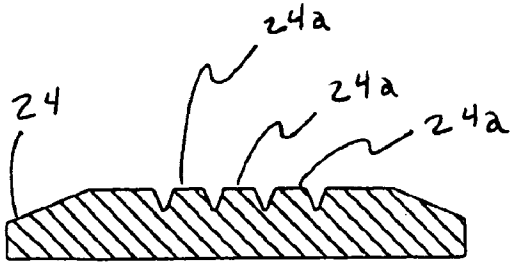
FIG. 7 is a cross-section of a further portion of the cushioning assembly that can be provided in the central region of the shoe and the illustrated embodiment.

Referring now to FIGS. 3, 4 and 7, the cushioning arrangement of the central region 3 (FIG. 8) will be described. FIG. 3 depicts a side view of the midsole without the cushioning elements 16, 20 and without the stiffening arrangement 18. Thus, the cushioning portion 22 noted earlier can be seen in side view. In the illustrated form, this arrangement is provided in the form of a series of ribs 22*a* separated by a series of notches, such as V-notches 22*b*. These ribs can extend across all or a portion of the width of the region 3 as depicted in FIG. 8. As noted earlier, these ribs can be integrally formed with the midsole 14. FIG. 7 depicts the opposing cushioning portion 24 having similar ribs 24*a*, which abut against the ribs 22*a* when assembled. Thus, the ribs 22*a*, 24*a* extend in the widthwise direction of the shoe. This arrangement can provide cushioning and also stability in the central region of the shoe due to the widthwise extension of the ribs. As noted earlier, a number of variations are possible. For example, as noted earlier, this central cushioning arrangement could be eliminated entirely in favor of an arrangement in which the stiffening spring/cushioning element combination extends across the entire width of the shoe. Alternately, in lieu of forming portions of the central cushioning arrangement integral with the midsole and providing a separate opposing corresponding cushioning element 24, both elements could be formed separate from the midsole 14 and inserted into a region beneath the midsole, or the cushioning arrangement in the central region 3 could be provided as a single insert (or multiple piece insert) which is inserted in a region beneath the midsole 14. As a further alternative, the central cushioning elements could be provided as only extensions formed as part of the midsole without an additional cushioning insert 24. In the illustrated arrangement, with the ribs 22*a* formed of the same material as the midsole 14, the opposing insert can also be formed of the same material as well. Optionally, the insert 24 could be formed of a different material, and where the cushioning portion 22 is formed separate from the midsole (or with the variations noted above where an alternate single or multi-piece inserts are provided in this region), the cushions provided in this central region 3 can be the same material or different materials from that of the midsole.

As noted earlier, the ribs 22*a* and 24*a* can optionally be disposed with respect to the cushioning elements 16, 20, such that a location exterior to the athletic shoe is visible through the ribs 22*a* and 24*a* (that is, the cushioning elements 16 and 20 and the ribs 22*a* and 24*a* can be staggered such that a user can see though the heel region of the athletic shoe).

Various materials are possible for the various cushioning elements. Therefore, it is to be understood that the materials identified herein are provided as examples. The more stiff or leaf spring arrangement 18 can be formed of a TPU (thermoplastic polyurethane) such as Hytrel. The cushioning elements 16, 20 can be formed of a material such as, for example, a TPR (thermoplastic rubber). It is to be understood however that other materials could also be used such as an EVA foam (ethylene vinyl acetate), a plastic, PVC, hytrel, rubber, TPU (thermoplastic polyurethane), silicone, or nylon.

As should be apparent, the arrangement of the invention can provide a number of advantageous features that can be utilized alone or in combination. Specifically, by providing different types of cushioning arrangements across the width of the shoe, the requirements of the shoe and the performance of the cushioning assemblies can be tailored to the forces to which that portion of the shoe is subjected while meeting the demands of shock absorption, comfort and stability. Further, by providing softer cushioning elements within a more rigid spring assembly or stiffening spring, cushioning and energy absorption are achieved while ensuring superior stability and preventing bottoming out of the assembly. Still further, by providing the more rigid arrangement at the sides of the shoe, not only is improved stability provided, but it is also possible to directly view the cushioning elements from the exterior of the shoe so that the user can see and even feel the cushioning elements, while the integrity of the sidewalls of the shoe is maintained. In addition, while the preferred embodiment utilizes this arrangement in the heel portion of the shoe, it is to be understood that various aspects could be utilized in other regions of the shoe as well.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An athletic shoe comprising:

(a) a sole assembly; and (b) a cushioning arrangement disposed within said sole assembly, said cushioning arrangement including:

(i) at least one cushioning element; and (ii) a stiffening spring at least partially surrounding said at least one cushioning element;

wherein said stiffening spring has a stiffness greater than said at least one cushioning element, a portion of said at least one cushioning element is disposed adjacent to a periphery of said shoe and said stiffening spring at least partially defines an aperture, said at least one cushioning element is disposed in said aperture such that said at least one cushioning element can be seen and touched from an exterior of said shoe, a first plurality of cushioning elements are disposed in said aperture, and a space that can be seen and touched from an exterior of said shoe after completion of assembly of the shoe is provided between adjacent ones of said first plurality of cushioning elements; and (iii) a second plurality of cushioning elements provided behind said first plurality of cushioning elements with respect to a viewing direction from an exterior of said shoe and through said aperture, said second plurality of cushioning elements staggered with respect to said first plurality of cushioning elements such that said second plurality of cushioning elements are visible through said spaces between said first plurality of cushioning elements, wherein said stiffening spring has a curved top disposed above said first plurality of cushioning elements and a substantially flat bottom disposed below said first plurality of cushioning elements such that said stiffening spring surrounds said first plurality of cushioning elements, and said second plurality of cushioning elements are not disposed within said stiffening spring.

2. An athletic shoe as recited in claim 1, wherein said stiffening spring and said first and second pluralities of cushioning elements are disposed in a heel region of said shoe, said shoe further including a central cushioning arrangement disposed in a central portion of said heel region, and wherein said central cushioning arrangement includes a plurality of cushioning ribs extending in a widthwise direction of said shoe.

3. An athletic shoe as recited in claim 2, wherein spaces between adjacent ones of said cushioning ribs of said central cushioning arrangement are staggered with respect to said first and second plurality of cushioning elements such that a line of sight is provided extending from a location exterior to said shoe and through said cushioning ribs and first and second cushioning elements.

4. An athletic shoe comprising:

(a) a sole assembly; and (b) two cushioning arrangements disposed within said sole assembly, a first of said cushioning arrangements disposed on a medial side of said shoe in a heel region of said shoe, and a second of said cushioning arrangements provided on a lateral side of said shoe in said heel region, each cushioning arrangement including:

(i) at least one cushioning element; and (ii) a stiffening spring at least partially surrounding said at least one cushioning element;

wherein said stiffening spring has a stiffness greater than said at least one cushioning element, a portion of said at least one cushioning element is disposed adjacent to a periphery of said shoe and said stiffening spring at least partially defines an aperture, said at least one cushioning element is disposed in said aperture such that said at least one cushioning element can be seen and touched from an exterior of said shoe, a first plurality of cushioning elements are disposed in said aperture, a space that can be seen and touched from an exterior of said shoe after completion of assembly of the shoe is provided between adjacent ones of said first plurality of cushioning elements, and said stiffening spring having a curved top disposed above said first plurality of cushioning elements and a substantially flat bottom disposed below said first plurality of cushioning elements such that said stiffening spring surrounds said first plurality of cushioning elements;

(iii) a second plurality of cushioning elements provided behind said first plurality of cushioning elements with respect to a viewing direction from an exterior of said shoe and through said aperture, said second plurality of cushioning elements staggered with respect to said first plurality of cushioning elements such that said second plurality of cushioning elements are visible through said spaces between said first plurality of cushioning elements; and (c) a central cushioning arrangement disposed in a central portion of said heel region, and wherein said central cushioning arrangement includes a plurality of cushioning ribs extending in a widthwise direction of said shoe.

5. An athletic shoe as recited in claim 4, wherein said cushioning ribs of said central cushioning arrangement and said first and second pluralities of cushioning elements are disposed such that a line of sight is provided extending from a location exterior to said shoe through said cushioning ribs and through said two cushioning arrangements such that a line of sight is provided extending through the width of said shoe in said heel region.

6. An athletic shoe comprising:

(a) a sole assembly; and (b) two cushioning arrangements disposed within said sole assembly, a first of said cushioning arrangements disposed on a medial side of said shoe in a heel region of said shoe, and a second of said cushioning arrangements provided on a lateral side of said shoe in said heel region, each cushioning arrangement including:

(i) at least one cushioning element; and (ii) a stiffening spring at least partially surrounding said at least one cushioning element, said stiffening spring including a curved top disposed above said at least one cushioning element and a substantially flat bottom disposed below said at least one cushioning element, wherein said stiffening spring has a stiffness greater than said at least one cushioning element, a portion of said at least one cushioning element is disposed adjacent to a periphery of said shoe and said stiffening spring at least partially defines an aperture, said at least one cushioning element is disposed in said aperture such that said at least one cushioning element can be seen and touched from an exterior of said shoe, a first plurality of cushioning elements are disposed in said aperture, and a space that can be seen and touched from an exterior of said shoe after completion of assembly of the shoe is provided between adjacent ones of said first plurality of cushioning elements, (c) a central cushioning arrangement disposed in a central portion of said heel region, and wherein said central cushioning arrangement includes a plurality of cushioning ribs extending in a widthwise direction of said shoe; and (d) a first set of cushioning elements disposed between said first cushioning arrangement and said central cushioning arrangement, and a second set of cushioning elements disposed between said second cushioning arrangement and said central cushioning arrangement.

7. An athletic shoe as recited in claim 6, wherein a first plurality of cushioning elements are disposed within said stiffening spring of said first cushioning arrangement and a second plurality of cushioning elements are disposed within said stiffening spring of said second cushioning arrangement.

8. An athletic shoe as recited in claim 7, wherein said first and second sets of cushioning elements, said first and second pluralities of cushioning elements, and said cushioning ribs of said central cushioning arrangement are disposed such that a line of sight extends through a width of said shoe in said heel region.

9. An athletic shoe comprising:

(a) a sole assembly;

(b) a plurality of cushioning arrangements provided across a width of said sole assembly, said plurality of cushioning arrangements including:

(i) a first cushioning assembly disposed on a medial side of said shoe;

(ii) a second cushioning assembly disposed adjacent to said first cushioning assembly on a lateral side of said first cushioning assembly, said first cushioning assembly and said second cushioning assembly at substantially a same position along a length direction of said shoe;

(iii) a third cushioning assembly on a lateral side of said second cushioning assembly;

(iv) a fourth cushioning assembly disposed such that said third cushioning assembly is disposed between said second and fourth cushioning assemblies; and (v) a fifth cushioning assembly disposed on a lateral side of said shoe, wherein said first and fifth cushioning assemblies each include: at least one cushioning element; and a stiffening spring at least partially surrounding said at least one cushioning element, wherein said stiffening spring has a stiffness greater than said at least one cushioning element; said stiffening spring includes a curved top disposed above said at least one cushioning element and a substantially flat bottom disposed below said at least one cushioning element;

wherein said first and fifth cushioning assemblies have a substantially similar stiffness; and wherein said second and fourth cushioning assemblies have a substantially similar stiffness which is less than said stiffness of said first and fifth cushioning assemblies.

10. An athletic shoe as recited in claim 9, wherein said second and fourth cushioning assemblies each include at least one cushioning element, said cushioning elements of said second and fourth cushioning assemblies being staggered relative to said cushioning elements of said first and fifth cushioning assemblies, such that said cushioning elements of said second and fourth cushioning assemblies are visible from locations exterior to said shoe.

11. An athletic shoe comprising:

(a) a sole assembly;

(b) a plurality of cushioning arrangements provided across a width of said sole assembly, said plurality of cushioning arrangements including:

(i) a first cushioning assembly disposed on a medial side of said shoe;

(ii) a second cushioning assembly disposed adjacent to said first cushioning assembly on a lateral side of said first cushioning assembly, said first cushioning assembly and said second cushioning assembly at substantially a same position along a length direction of said shoe;

(iii) a third cushioning assembly on a lateral side of said second cushioning assembly;

(iv) a fourth cushioning assembly disposed such that said third cushioning assembly is disposed between said second and fourth cushioning assemblies; and (v) a fifth cushioning assembly disposed on a lateral side of said shoe, wherein said first and fifth cushioning assemblies each include:

at least one cushioning element; and a stiffening spring at least partially surrounding said at least one cushioning element, wherein said stiffening spring has a stiffness greater than said at least one cushioning element, said second and fourth cushioning assemblies each include at least one cushioning element, said cushioning elements of said second and fourth cushioning assemblies being staggered relative to said cushioning elements of said first and fifth cushioning assemblies, such that said cushioning elements of said second and fourth cushioning assemblies are visible from locations exterior to said shoe, and said third cushioning assembly includes a plurality of cushioning ribs extending along said width of said shoe.

12. An athletic shoe as recited in claim 11, wherein said cushioning ribs and said cushioning elements are positioned such that a line of sight extends through the width of said shoe.

13. An athletic shoe comprising:

(a) a sole assembly; and (b) a cushioning arrangement disposed within said sole assembly, said cushioning arrangement including:

(i) at least two cushioning elements, a first of said cushioning elements disposed on a medial side of said shoe in a heel region of said shoe and a second of said cushioning elements provided on a lateral side of said shoe in said heel region;

(ii) a stiffening spring at least partially surrounding each cushioning element, said stiffening spring having a stiffness greater than each cushioning element;

(iii) a central cushioning arrangement disposed in a central portion of said heel region, said central cushioning arrangement including a plurality of cushioning ribs spaced apart from each other in a lengthwise direction of said shoe and extending in a widthwise direction of said shoe; and (iv) a first set of cushioning elements disposed between said first cushioning element and said central cushioning arrangement, and a second set of cushioning elements disposed between said second cushioning element and said central cushioning arrangement, wherein a first plurality of cushioning elements are disposed within said stiffening spring of said first cushioning element and a second plurality of cushioning elements are disposed within said stiffening spring of said second cushioning element.

14. An athletic shoe as recited in claim 13, wherein said first and second sets of cushioning elements, said first and second pluralities of cushioning elements, and said cushioning ribs of said central cushioning arrangement are disposed such that a line of sight extends through a width of said shoe in said heel region.

* * * * *